US005910272A

United States Patent [19]

Kushibiki et al.

[11] Patent Number: 5,910,272

[45] Date of Patent: Jun. 8, 1999

[54] PROCESS FOR THE PREPARATION OF AN ELECTRICALLY CONDUCTIVE COATING MATERIAL

[75] Inventors: Nobuo Kushibiki; Kikuko Takeuchi, both of Kanagawa, Japan

[73] Assignee: Dow Corning Asia, Ltd., Tokyo, Japan

[21] Appl. No.: 09/040,889

[22] Filed: Mar. 18, 1998

[30] Foreign Application Priority Data

Mar. 19, 1997 [JP] Japan ..... 9-066849

[51] Int. Cl.[6] ..... H01B 1/04

[52] U.S. Cl. ..... 252/500; 528/34; 528/43; 528/10

[58] Field of Search ..... 252/500, 301.34; 528/4, 38, 43, 34

[56] References Cited

U.S. PATENT DOCUMENTS 3,986,997 10/1976 Clark ..... 260/29.2 M 5,708,099 1/1998 Kushibiki ..... 525/477

FOREIGN PATENT DOCUMENTS 57-30843 of 1982 Japan .

5-46940 of 1993 Japan .

*Primary Examiner*—Mark Kopec

*Assistant Examiner*—Derrick G. Hamlin

*Attorney, Agent, or Firm*—Sharon K. Severance

[57] ABSTRACT

A process for the preparation of an electrically conductive coating material for use in electrophotography applications comprises subjecting an epoxy-functional silane to hydrolytic condensation in a mixed solvent of alcohol and water in the presence of silica. The hydrolyzed material is then heat cured to form a resin coating comprising $(R^1SiO)_{3/2}$ units, where $R^1$ comprises epoxy-functional groups. The coating has superior optical homogeneity and electrical conductivity without being detrimental to the functionality required of electrophotographic photosensitive bodies.

14 Claims, No Drawings

PROCESS FOR THE PREPARATION OF AN ELECTRICALLY CONDUCTIVE COATING MATERIAL

FIELD OF THE INVENTION

This invention relates to a process for the preparation of an electrically conductive coating material for use in electrophotography applications. The coating material, when applied in the surface layer of electrophotographic photosensitive bodies, is not detrimental to the electrophotographic characteristics of the photosensitive material layer, possesses charge transfer ability, and can impart wear resistance.

BACKGROUND OF THE INVENTION

Repeated electrical or mechanical operations affect the surface of photosensitive bodies used in electrophotographic applications. Examples of such operations include cleaning, transfer, and image development processes; or roller electrical charging, corona electrical charging, and other electrical charging processes. Because the surface of photosensitive bodies is subjected to wear and undergoes degradation due to friction and such during cleaning and electrical charging, there is a demand for improvements in terms of the durability of photosensitive bodies.

Attempts to improve characteristics by reducing surface energy are known in the art. For example, attempts to reduce surface energy have been made by adding polydimethylsiloxane oils or silicone oils and other polysiloxane resins, such as polytetrafluoroethylene to the photosensitive layer to increase the durability of photosensitive bodies.

A protective layer may be formed on the surface of photosensitive bodies. For example, JP-A-57-30843 (1982) discloses using coating materials obtained by dispersing electrically conductive particles in various resins. JP-C-05-46940 (1993) discloses applying a surface-protecting layer of crosslinked polysiloxane to the surface of photosensitive bodies. The polysiloxane is composed of a product of joint hydrolytic condensation of a trifunctional alkoxysilane and a tetrafunctional alkoxysilane.

In electrophotographic processes, it is necessary to neutralize the electric charge on the surface of the photosensitive body with the electric charge generated in the charge generating layer, and the electric charge has to be transferred through the coating layer on the surface of the photosensitive body. Therefore, the coating materials must be electrically conductive. Electrical conductivity can be imparted to coating materials by dispersing in the coating material, carbon and particles of metals and metallic compounds, such as aluminum, copper, silver, gold, indium oxide, tin oxide, and the like. However, when such particles are dispersed, the formation of primary or secondary particles can cause light scattering that causes a decrease in sensitivity and image degradation.

One object of this invention is to provide a process for the preparation of an electrically conductive coating material that forms a protective layer of polysiloxane for electrophotographic photosensitive bodies. A further object of this invention is to produce a coating material that has superior optical homogeneity and is not detrimental to the functionality of the electrophotographic photosensitive bodies.

SUMMARY OF THE INVENTION

This invention relates to a process for the preparation of an electrically conductive coating material comprising subjecting an epoxy-functional silane to hydrolytic condensation in a mixed solvent of alcohol and water in the presence of finely divided silica. The silane has a general formula $R^2Si(OR^3)_3$ where each $R^2$ is selected from the group consisting of epoxy-functional organic groups, saturated hydrocarbon groups, and aromatic hydrocarbon groups, with the proviso that at least some of the $R^2$ groups are epoxy-functional organic groups; and $R^3$ is a straight-chain saturated hydrocarbon group.

The coating material is then heat cured to form a resin comprising $R^1SiO_{3/2}$ units, where each $R^1$ is selected from the group consisting of epoxy-functional groups, saturated hydrocarbon groups, and aromatic hydrocarbon groups.

The coating produced by this process has superior optical homogeneity and electrical conductivity without being detrimental to the functionality required of electrophotographic photosensitive bodies.

DETAILED DESCRIPTION OF THE INVENTION

The present invention is a process for the preparation of a coating material. The coating material is a polysiloxane obtained by hydrolytically condensing a silane (2) having the formula $R^2Si(OR^3)_3$, wherein $R^2$ is selected from the group consisting of epoxy-functional organic groups, saturated hydrocarbon groups of 1 to 18 carbon atoms, and aromatic hydrocarbon groups of 6 to 18 carbon atoms, with the proviso that at least some of the $R^2$ groups are epoxy-functional organic groups. $R^3$ is a straight-chain saturated hydrocarbon group of 1 to 8 carbon atoms.

Hydrolytic condensation is carried out in a mixed solvent containing alcohol and water in the presence of finely divided silica. The amount of water in the solvent is not less than the weight necessary for the hydrolytic condensation of the silane. Heat curing after hydrolytic condensation of the silane (2) gives an electrically conductive coating film with volume resistivity in the range of not less than $1\times10^9$ Ωcm and not more than $1\times10^{14}$ Ωcm.

Polysiloxane resin (1), having the formula $R^1SiO_{3/2}$, is produced by heat curing the silane (2) after its hydrolytic condensation. In the polysiloxane resin (1), $R^1$ is selected from the group consisting of epoxy-functional organic groups, saturated hydrocarbon groups of 1 to 18 carbon atoms, and aromatic hydrocarbon groups of 6 to 18 carbon atoms, with the proviso that at least some of the $R^1$ groups are epoxy-functional organic groups.

Suitable epoxy-functional organic groups for $R^1$ are exemplified by γ-glycidoxypropyl, β-(3,4-epoxycyclohexyl) ethyl, and the like. Suitable saturated hydrocarbon groups have 1 to 18 carbon atoms. The saturated hydrocarbon groups can have straight-chain or branched structure. The saturated hydrocarbon groups are exemplified by methyl, ethyl, butyl, amyl, hexyl, 2-ethylhexyl, dodecyl, octadecyl, and the like. Suitable aromatic hydrocarbon groups have 6 to 18 carbon atoms, and are exemplified by phenyl, tolyl, and the like.

The amount of the finely divided silica that can be added is preferably 1 to 200 parts by weight per 100 parts by weight of the polysiloxane. When it is less than 1 part by weight, the effects are insufficient, and when it exceeds 200 parts by weight, the cured product of the coating material becomes brittle. Preferably, 10 to 100 parts by weight is added. To form a homogeneous heat cured coating film, the finely divided silica should have an average diameter of primary particles of not more than 100 nm, and preferably, not more than 50 nm. The finely divided silica may be surface treated to suppress formation of secondary particles, thereby achieving uniform dispersion of the silica in the solvent, as long as the treatment does not create obstacles to preparing the polysiloxane resin.

Preferably, solvents used during synthesis are selected from lower alcohols. Finely divided silica dispersed in a lower alcohol is mixed with the solvent containing a sufficient amount of water necessary for the hydrolysis of the silane (2). The silane is added thereto and subjected to hydrolysis.

The condensation of the silane can be accelerated by adding catalysts. Because the resin is used for electrophotographic photosensitive bodies, it is preferable to avoid the use of primary or secondary amines, which affect charge transfer. Organic acids, for example, formic acid, acetic acid, propionic acid, oxalic acid, malonic acid, glutaric acid, glycolic acid, tartaric acid, and the like, as well as esters of these acids, are suitable catalysts.

When the reaction is carried in this manner, the silanol groups remaining in the finely divided silica and the hydrolyzed silane compound react with each other, and silica is chemically fixed in the polysiloxane. As a result, when the material is applied as a coating and cured, the strength of the coating tends to improve. Hydroxyl groups and hydrolyzable groups are examples of the groups bonded to silicon in the molecule that remain in the polysiloxane produced from the silane. Residual hydroxyl groups and hydrolyzable groups are commonly used as crosslinkable functional groups. If there is an excessive amount of residual hydroxyl groups or hydrolyzable groups, the storage stability of the polysiloxane tends to drop. If the amount is too small, sufficient crosslinking does not take place.

Preferably, the amount of hydroxyl and hydrolyzable groups bonded to silicon atoms contained in the polysiloxane is 0.1 to 4 wt %. The amount of these groups can be set to the desired range by using methods known in the art. For example, in the case of hydroxyl groups, alkoxysilanes and such can be added during or after the synthesis of polysiloxane. When crosslinking a polysiloxane with an adjusted amount of hydrolyzable groups, crosslinking can be carried out by adding crosslinking agents. Suitable crosslinking agents should be silicon compounds having siloxane bonds and having multiple hydrolyzable groups or hydroxyl groups in each molecule. Methoxy, ethoxy, propoxy, acetoxy, butoxy, and methylethylketoxime are examples of suitable hydrolytic groups.

Catalysts known in the art can also be added in the process of curing to the coating materials, as long as they do not hamper charge transfer in the electrophotographic photosensitive bodies. Suitable catalysts include dimethylamine acetate, ethanolamine acetate, dimethylaniline formate, tetraethylammonium benzoate, sodium acetate, sodium propionate, sodium formate, benzyltrimethylammonium acetate, dibutyltin dilaurate, and the like.

The volume resistivity of the cured products of the coating material of this invention is suitable for coating films used on electrophotographic photosensitive bodies. When the volume resistivity value is less than $1\times10^{9}$ Ωcm, problems with image degradation are caused by the scattering of the electric charge of the formed linear images. When volume resistivity exceeds $1\times10^{14}$ Ωcm, electric charge transfer is insufficient, residual potential is generated, and sensitivity decreases.

It is theorized that the epoxy groups contained in the epoxy-functional organic groups bonded to the silicon atoms are simultaneously subjected to hydrolysis during hydrolytic condensation, undergo ring opening, and are converted to hydroxyl groups. It is further theorized that this contributes to volume resistivity. Therefore, volume resistivity can be adjusted by changing the ratio of the epoxy-containing organic groups and other organic groups. Volume resistivity of $2\times10^{15}$ Ωcm when the organic groups other than the epoxy-functional organic groups were methyl groups dropped to $2\times10^{13}$ Ωcm when 30 mol % of methyl groups were replaced with glycidoxy groups.

The resin can be used as a protective film formed on an electrophotographic photosensitive body. It is essential that dispersion of the resin be carried out in solvents that are inert with respect to the chemical substances constituting the charge transfer layer. Pinene, as well as anthracene and other polycyclic aromatic compounds, carbazole, indole, oxazole, thiazole, oxathiazole, pyrazole, pyrazoline, thiadiazole, as well as triazole and other heterocyclic compounds, p-diethylaminobenzaldehydo-N,N-diphenylhydrazone, as well as N,N-diphenylhydrazino-3-methylidene-9-ethylcarbazole and other hydrazone compounds, α-phenyl-4'-N,N-diphenylaminostilbene, as well as 5-(4-(di-p-tolylamino)benzylidene)-5lH-dibenzo(a,d)cycloheptene and other stilbene compounds, benzidine compounds, triarylamine compounds or high molecular compounds having groups made up of these compounds in the main chain or side chains (poly-N-vinyl carbazole, polyvinyl anthracene, and the like) are examples of the charge transfer substances.

When the charge transfer substance lacks film-forming capability, high molecular compounds that can be mixed therewith are used as binders. Polyester, polycarbonate, polystyrene, polymethacrylic acid esters, polyacrylic acid esters, and the like, are examples of suitable binders. Preferably, the amount of the charge transfer compounds used in the charge transfer layer is not less than 20 wt % and not more than 70 wt % relative to the solid matter of the charge transfer layer. If it is less than 20 wt %, sufficient charge transportability is not obtained, resulting in undesirable increase in residual potential and such. When the amount of charge transfer compounds exceeds 70 wt %, the mechanical strength of the charge transfer layer decreases, causing insufficient durability. When used in a single-layer photosensitive body, excellent characteristics are obtained by using a composition prepared by combining a high molecular compound, a charge transfer compound, and a charge generating material.

Cured products of the electrically conductive coating material of this invention can be formed as a surface-protecting layer on top of a photoconductive layer of the above composition. Solvents that do not adversely affect the photoconductive layer are preferable as the solvents employed in the compositions used for the formation of the surface-protecting layer. The compositions are applied by dip coating, blade coating, roller coating, and other techniques. Therefore, in resin coating solutions used to form surface-protecting layers in solvents that are inert with respect to the charge transfer materials and high polymers serving as their binders, alcohols, and, in particular, when drying after coating is taken into consideration, methanol, ethanol, isopropanol, butanol, and other lower alcohols are preferable as the solvents that do not cause their swelling or dissolution.

The resin obtained by heat curing the coating material has optical characteristics required of photosensitive bodies used in electrophotography and an electrical conductivity that is effective in suppressing frictional electrification, and is appropriate for achieving improvements in terms of its ability to withstand cleaning, so that surface tension does not drop after repeated cleaning and charging, as well as improvements in terms of wear properties during toner cleaning, and the like.

In addition, adding leveling agents known in the art, such as polyester-modified silicones, and the like, to coating materials prepared of the present invention is acceptable as long as it is not detrimental to the effects of the present invention.

EXAMPLES

These examples are intended to illustrate the invention to those skilled in the art and should not be interpreted as limiting the scope of the invention set forth in the claims.

"Water-base dispersion S of colloidal silica" and "isopropyl alcohol dispersion T of colloidal silica" are defined in Table 1. Particle Diameters are expressed in nm.

TABLE 1

| | Manufacturer | Product Name | Particle Diameter | Content of $SiO_2$ (wt %) |
|---|---|---|---|---|
| Water-base dispersion S of colloidal silica | Nissan Chemical Industries, Ltd. | Snowtex 40 | 10~20 | 40 |
| Isopropyl alcohol dispersion T of colloidal silica | Nissan Chemical Industries, Ltd. | IPA-ST | 10~20 | 30 |

Example 1

14.2 g of water-base dispersion S of colloidal silica was placed in a flask, and 79.8 g of isopropyl alcohol dispersion T of colloidal silica, 22.7 g methyltriethoxysilane, 30.2 g of g-glycidoxypropyltrimethoxysilane, and 9.6 g of acetic acid were added thereto under agitation. This solution was heated to 65~70° C., and reaction was conducted for 2 hours. The product was then diluted with 26.2 g of isopropyl alcohol, and 7.4 g of dibutyltin dilaurate, as a curing catalyst, was gradually added thereto. The product was applied to a plate to produce a layer with a thickness of 15 microns and heat cured at a temperature of 130° C., whereupon a counter electrode was fabricated by depositing a 1-micron layer of gold. Resistance was measured by connecting lead wires and applying a voltage of 50 V. The results are in Table 2.

Example 2

65.8 g of water-base dispersion S of colloidal silica was placed in a flask, and a mixture of 14.6 g of g-glycidoxypropyltrimethoxysilane and 47.5 g of methyltrimethoxysilane, 5.0 mL of distilled water, and 7.0 g of acetic acid was added thereto under agitation. The solution was then heated to 55° C. and agitated for 30 minutes while maintaining a temperature of 50~60° C.

The reaction mixture was then cooled to 20° C. When its temperature was stabilized, the mixture was agitated for 30 minutes. The reaction mixture was diluted with 54.3 g of isopropyl alcohol, and 6.0 g of dibutyltin dilaurate was gradually added thereto. Precipitate was removed from the reaction mixture, and the product was used for coating after ripening at room temperature for 2~3 days. Volume resistivity was measured in the same manner as in Example 1. The results are shown in Table 2.

Comparative Example 1

A polysiloxane that did not contain g-glycidoxypropyl groups was synthesized by using the same method as in Example 1. 60.0 g water-base dispersion S of colloidal silica was placed in a flask, and ⅓ of a mixture of 43.0 g of methyltrimethoxysilane and 7.0 g of acetic acid was added thereto under agitation. After addition, the solution was heated to 55° C. and, immediately upon observing a violent exothermic reaction, it was cooled on ice and the rest of the mixture was added thereto while maintaining a temperature of 50~60° C. in the flask.

The reaction mixture was then cooled to 20° C. When its temperature was stabilized, the mixture was agitated for 30 minutes. The reaction solution was then diluted with 35.6 g of isopropyl alcohol, and 4.8 g of dibutyltin dilaurate was gradually added thereto. Volume resistivity was measured in the same manner as in Example 1. The results are shown in Table 2.

TABLE 2

| Polysiloxane | Percentage of g-glycidoxypropyl groups (wt %) | External Appearance | Volume Resistivity (Ωcm) |
|---|---|---|---|
| Example 1 | 35.7 | Transparent | 5.3E + 12 |
| Example 2 | 17.1 | Transparent | 3.2E + 13 |
| Comparative Example 1 | 0.0 | Transparent | 6.0E + 15 |

We claim:

1. A process for preparing an electrically conductive coating comprising:

(i) forming a polysiloxane by hydrolytically condensing a silane of formula $R^2Si(OR^3)_3$ in a mixed solvent, wherein the mixed solvent comprises an alcohol and water, in the presence of finely divided silica; wherein $R^2$ is selected from the group consisting of epoxy-functional organic groups, saturated hydrocarbon groups of 1 to 18 carbon atoms, and aromatic hydrocarbon groups of 6 to 18 carbon atoms, with the proviso that at least some of the $R^2$ groups are epoxy-functional organic groups; and $R^3$ is a saturated hydrocarbon group of 1 to 8 carbon atoms; and (ii) curing the polysiloxane to form a polysiloxane resin of formula $R^1SiO_{3/2}$; wherein $R^1$ is selected from the group consisting of epoxy-functional organic groups, saturated hydrocarbon groups of 1 to 18 carbon atoms, and aromatic hydrocarbon groups of 6 to 18 carbon atoms, with the proviso that at least some of the $R^1$ groups are epoxy-functional organic groups; and wherein the electrically conductive coating has a volume resistivity of not less than $1\times10^9$ Ωcm and not more than $1\times10^{14}$ Ωcm.

2. The process of claim 1, wherein the epoxy-functional organic groups for $R^1$ are selected from the group consisting of γ-glycidoxypropyl and β-(3,4-epoxycyclohexyl)ethyl.

3. The process of claim 1, wherein the saturated hydrocarbon groups for $R^1$ are selected from the group consisting of methyl, ethyl, butyl, amyl, hexyl, 2-ethylhexyl, dodecyl, and octadecyl.

4. The process of claim 1, wherein the aromatic hydrocarbon groups for $R^1$ are selected from the group consisting of phenyl and tolyl.

5. The process of claim 1, wherein the amount of finely divided silica is 1 to 200 parts by weight per 100 parts by weight of polysiloxane.

6. The process of claim 5, wherein the amount of finely divided silica is 10 to 100 parts by weight.

7. The process of claim 1, wherein the finely divided silica has an average diameter of primary particles of not more than 100 nm.

8. The process of claim 7, wherein the average diameter of primary particles is not more than 50 nm.

9. The process of claim 1, wherein hydrolytically condensing the silane is accelerated by adding a catalyst selected from the group consisting of organic acids and esters of organic acids.

10. The process of claim 9, wherein the polysiloxane contains 0.1 to 4 weight % hydroxyl groups and hydrolyzable groups.

11. The process of claim 1, wherein a catalyst is added when curing the polysiloxane.

12. The process of claim 11, wherein the catalyst is selected from the group consisting of dimethylamine acetate, ethanolamine acetate, dimethylaniline formate, tetraethylammonium benzoate, sodium acetate, sodium propionate, sodium formate, benzyltrimethylammonium acetate, and dibutyltin dilaurate is added.

13. The process of claim 1, wherein a leveling agent is added.

14. The process of claim 13, wherein the leveling agent is a polyester-modified silicone.

* * * * *